US009670837B2

(12) United States Patent
Honzawa et al.

(10) Patent No.: US 9,670,837 B2
(45) Date of Patent: Jun. 6, 2017

(54) ENGINE-POWERED WORK TOOL PROVIDED WITH WIND GOVERNOR THAT PERFORMS IGNITION CONTROL

(71) Applicant: HITACHI KOKI CO., LTD., Tokyo (JP)

(72) Inventors: Hiroshi Honzawa, Hitachinaka (JP); Shigetoshi Ishida, Chiba (JP)

(73) Assignee: Hitachi Koki Co., Ltd., Tokyo (JP)

( * ) Notice: Subject to any disclaimer, the term of this patent is extended or adjusted under 35 U.S.C. 154(b) by 263 days.

(21) Appl. No.: 14/579,510

(22) Filed: Dec. 22, 2014

(65) Prior Publication Data

US 2015/0184595 A1 Jul. 2, 2015

(30) Foreign Application Priority Data

Dec. 27, 2013 (JP) ..... 2013-272355

(51) Int. Cl.
*F02D 9/02* (2006.01)
*F02B 63/02* (2006.01)
(Continued)

(52) U.S. Cl.
CPC ..... *F02B 63/02* (2013.01); *F02D 9/1065* (2013.01); *F02D 31/00* (2013.01); *F02D 41/1498* (2013.01); *F02M 35/1017* (2013.01); *F02M 35/10196* (2013.01); *F02P 9/005* (2013.01); *F02P 11/02* (2013.01); *F01P 5/02* (2013.01); *F01P 5/04* (2013.01);
(Continued)

(58) Field of Classification Search
CPC ..... F02B 63/02; F02D 31/00; F02D 2400/06; F02D 9/1065; F02D 2009/0203; F02D 2009/0216; F01P 1/02; F01P 5/02
USPC ..... 123/41.58, 41.11, 41.56, 41.63, 41.65, 123/363–367, 398, 400, 403
See application file for complete search history.

(56) References Cited

U.S. PATENT DOCUMENTS 2,835,237 A * 5/1958 Thorner ..... F02D 11/08 123/352
3,104,657 A * 9/1963 Rice ..... F02D 9/00 123/392

(Continued)

FOREIGN PATENT DOCUMENTS

JP H06-123243 A 5/1994

OTHER PUBLICATIONS

U.S. Appl. No. 14/579,653, filed Dec. 22, 2014, Ikeda et al.

*Primary Examiner* — Long T Tran
(74) *Attorney, Agent, or Firm* — Kilpatrick Townsend & Stockton LLP

(57) ABSTRACT

An engine-powered work tool includes an engine having a crank shaft, an ignition system, an output controller having a throttle valve shaft for controlling output of the engine, a wind governor connected to the throttle valve shaft, a rotation speed detector and an ignition control unit. The wind governor includes a governor plate movable upon receipt of cooling air generated by a cooling fan to control an angular rotation of the throttle valve shaft. The rotation speed detector detects a rotation speed of the crank shaft. The ignition control unit controls the ignition system based on the rotation speed of the crank shaft detected by the rotation speed detector to reduce the output of the engine when the rotation speed detector determines that the governor plate exceeds a predetermined position.

10 Claims, 8 Drawing Sheets

(51) Int. Cl.

| | |
|---|---|
| ***F02M 35/10*** | (2006.01) |
| ***F02D 41/14*** | (2006.01) |
| ***F02P 9/00*** | (2006.01) |
| ***F02P 11/02*** | (2006.01) |
| ***F02D 9/10*** | (2006.01) |
| ***F02D 31/00*** | (2006.01) |
| *F01P 5/04* | (2006.01) |
| *F01P 5/02* | (2006.01) |

(52) U.S. Cl.
CPC ..... *F02D 2009/0203* (2013.01); *F02D 2009/0208* (2013.01); *F02D 2200/101* (2013.01); *F02D 2400/06* (2013.01)

(56) References Cited

U.S. PATENT DOCUMENTS

| | | | | | |
|---|---|---|---|---|---|
| 3,118,433 | A * | 1/1964 | Lechtenberg | F01P 1/02 | 123/41.31 |
| 3,850,155 | A * | 11/1974 | Thomas | F02B 77/08 | 123/198 D |
| 4,662,328 | A * | 5/1987 | Kronich | F02B 63/02 | 123/196 R |
| 4,836,167 | A * | 6/1989 | Huffman | F02D 9/02 | 123/337 |
| 2009/0317262 | A1* | 12/2009 | Gilpatrick | B08B 3/026 | 417/34 |
| 2011/0226217 | A1* | 9/2011 | Raasch | F02D 31/00 | 123/376 |
| 2012/0304963 | A1* | 12/2012 | Raasch | F02D 31/00 | 123/376 |

* cited by examiner

ENGINE-POWERED WORK TOOL PROVIDED WITH WIND GOVERNOR THAT PERFORMS IGNITION CONTROL

CROSS REFERENCE TO RELATED APPLICATION

This application claims priority from Japanese Patent Application No. 2013-272355 filed Dec. 27, 2013, the entire content of which is incorporated herein by reference.

TECHNICAL FIELD

The present invention relates to a portable work tool provided with a compact engine, such as a brush cutter.

BACKGROUND

A compact engine is employed as a power source in an electric generator and a portable work tool such as a grass-trimmer, a brush cutter, a blower, a chain-saw, and a power cutter.

Such a conventional engine includes a cooling fan provided on one end of a crank shaft for cooling a cylinder. Rotation of the crank shaft causes the cooling fan to rotate, thereby generating cooling air for cooling the cylinder.

Japanese Patent Application. Publication No. H06-123243 discloses a mechanism in which a wind governor is employed to utilize cooling air for controlling operational states (rotation speed) of an engine. Specifically, a governor plate is disposed on an air flow path of the cooling air within a fan case. The governor plate is connected to a throttle valve shaft of a carburetor that controls a throttle opening in the carburetor. The governor plate is pivotally movable about this throttle valve shaft.

Specifically, in this wind governor, the throttle valve shaft is caused to rotate to decrease the throttle opening when a load decreases, a rotation speed increases, and wind power of cooling air becomes stronger. Conversely, the throttle valve shaft is caused to rotate to increase the throttle opening when the load increases, the rotation speed drops, and wind power of cooling air becomes weaker.

This mechanism is easily configured by simply connecting a small-sized governor plate (wind governor) to the throttle valve shaft and is therefore effective in various types of portable engine-powered work tools that require compact engines.

SUMMARY

The output of the engine in a working state can be controlled appropriately by the wind governor. However, control using the wind governor considerably suppresses an output of the engine that can be originally generated by the engine. That is, when the wind governor is employed, the output obtained from the engine is suppressed and is considerably smaller than in a case where the wind governor is not employed.

A larger engine output in the working state can still be obtained, even if the wind governor is employed, by improving the structure around the carburetor and the wind governor. In this case, however, because these structures become complicated, an advantage of the wind governor that the above-described control can be performed with a simple structure is impaired. Still further, an actuator or the like can be employed to perform the above-described controls. In this case, too, however, a complicated structure is needed, which is not desirable for a brush cutter and the like that needs to be small and lightweight.

It is thus difficult to improve an engine output in a portable work tool provided with a wind governor, through a simple configuration.

In view of the foregoing, it is an object of the present invention to provide a work tool provided with a wind governor capable of overcoming the above-described drawbacks.

In order to attain the above and other objects, the invention provides an engine-powered work tool including an air-cooled engine, an ignition system for igniting the engine, an output controller, a wind governor, a rotation speed detector and an ignition control unit. The air-cooled engine includes a crank shaft configured to rotate and a cooling fan fixed to the crank shaft and configured to rotate together with the crank shaft to generate cooling air. The output controller is configured to control an output of the engine, the output controller including a throttle valve shaft defining an axis and configured to make an angular rotation about the axis, the output of the engine being controlled based on the angular rotation of the throttle valve shaft. The wind governor is connected to the throttle valve shaft and includes a governor plate configured to move upon receipt of the cooling air thereon, the wind governor being configured to control the angular rotation of the throttle valve shaft based on an amount of the cooling air received by the governor plate. The rotation speed detector is configured to detect a rotation speed of the crank shaft. The ignition control unit is configured to control the ignition system based on the rotation speed of the crank shaft detected by the rotation speed detector to reduce the output of the engine when the rotation speed detector determines that the governor plate exceeds a predetermined position.

Preferably, the ignition control unit is configured to reduce the output of the engine by changing ignition timing for igniting the engine when the rotation speed detector determines that the rotation speed of the crank shaft exceeds a predetermined value corresponding to the predetermined position.

Preferably, the ignition control unit is configured to reduce the output of the engine by thinning out a frequency of ignition when the rotation speed detector determines that the rotation speed of the crank shaft exceeds a predetermined value corresponding to the predetermined position.

Preferably, the rotation speed detector is configured to detect the rotation speed of the crank shaft based on a position of the governor plate that moves in accordance with the amount of the cooling air.

Preferably, the ignition control unit is configured to control the ignition system to reduce the output of the engine when the governor plate moves to pass the predetermined position upon receipt of the cooling air.

Preferably, the wind governor is configured to determine a designated rotation speed of the crank shaft of the engine operating under no load, and the predetermined position is determined based on the designated rotation speed of the crank shaft determined by the wind governor.

Preferably, the rotation speed detector includes a position sensor configured to detect a position of the governor plate and to output information indicative of the position of the governor plate, and the ignition control unit is configured to control the ignition system based on the information outputted from the position sensor.

Preferably, the ignition system includes an ignition coil configured to generate spark current for igniting the engine, the ignition control unit being positioned adjacent to the ignition coil.

Preferably, the output controller includes a main body through which the throttle valve shaft penetrates, the throttle valve shaft having one end and another end opposite to each other, the governor plate being fixed to the one end of the throttle valve shaft, and the wind governor further includes: an arm fixed to the another end of the throttle valve shaft; and a governor spring connected to the arm to apply a biasing force to the throttle valve shaft.

Preferably, the engine-powered work tool further includes: an end tool configured to be driven in accordance with the rotation of the crank shaft; and a supporting shaft having one end provided with the end tool and another end provided with the air-cooled engine, the ignition system, the output controller, the wind governor and the ignition control unit.

DETAILED DESCRIPTION

A brush cutter 310 as an example of an engine-powered work tool according to an embodiment of the present invention will be described with reference to FIGS. 1A through 9B.

Descriptions used in the following description in relation to the brush cutter 310 will reference the state of the brush cutter 310 shown in FIG. 1A assuming that the brush cutter 310 is placed on the ground. Specifically, hereinafter, left and right sides of the brush cutter 310 shown in FIG. 1A will be referred to as the "front side" and "rear side" respectively and an up-down direction in FIG. 1A will be referred to as an up-down direction or a vertical direction.

Figure 1A:
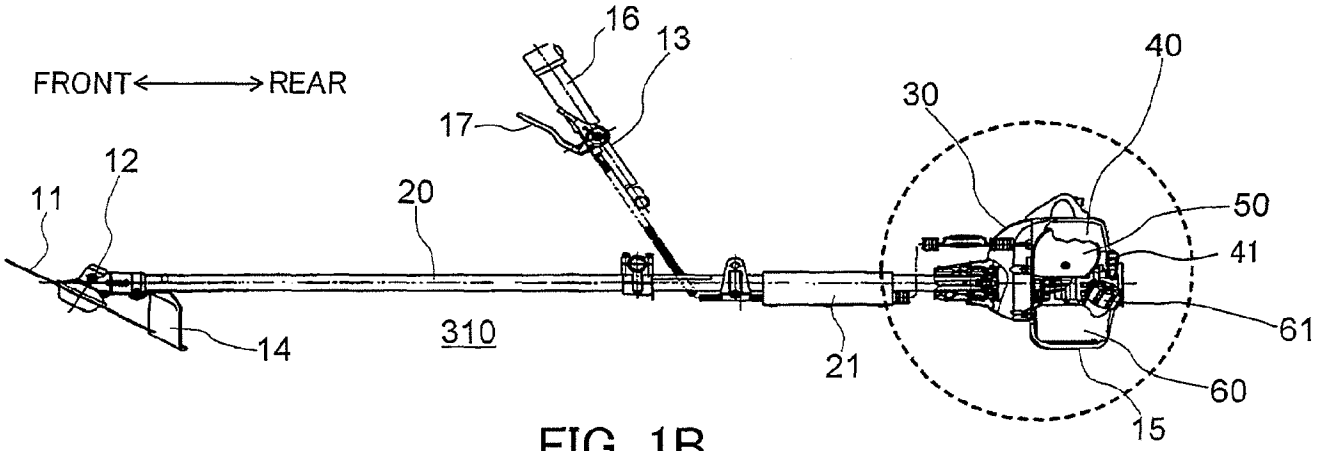
FIG. 1A is a side view showing a general construction of a brush cutter according to an embodiment of the present invention.
Figure 1B:
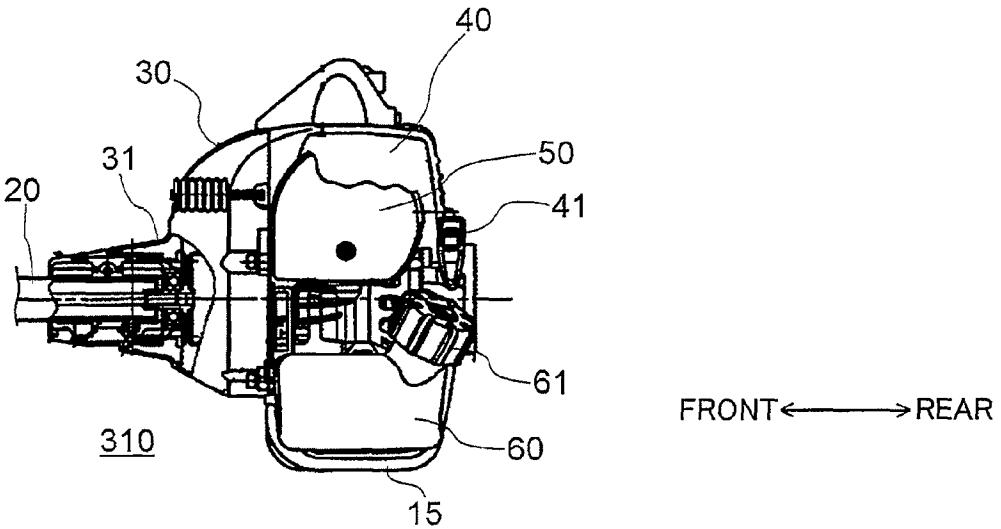
FIG. 1B is an enlarged cross-sectional view of a drive section of the brush cutter of the embodiment enclosed by a broken line in FIG. 1A.

Referring to FIGS. 1A and 1B, the brush cutter 310 includes a shaft 20 extending in a front-rear direction, a cutting blade 11, and a drive section 30 that accommodates an engine 40. The cutting blade 11 is rotatably provided on a front end portion (one end) of the shaft 20 as an example of an end tool. The drive section 30 is disposed at a rear end portion (another end) of the shaft 20 for driving (rotating) the cutting blade 11. The engine 40 is used as a power source of the drive section 30. A drive shaft (not shown) is coaxially disposed within the shaft 20 and is connected to a crank shaft 42 (see FIG. 2) of the engine 40 through a centrifugal clutch 46 (see FIG. 2). When a rotation speed of the crank shaft 42 increases and the centrifugal clutch 46 is connected to the drive shaft, the drive shaft (not shown) starts to rotate upon receipt of the drive power from the engine 40. This rotation of the drive shaft is transmitted to a gear case 12 provided at the front end portion of the shaft 20 to rotate the cutting blade 11 at an appropriate speed reduction ratio.

Figure 3:
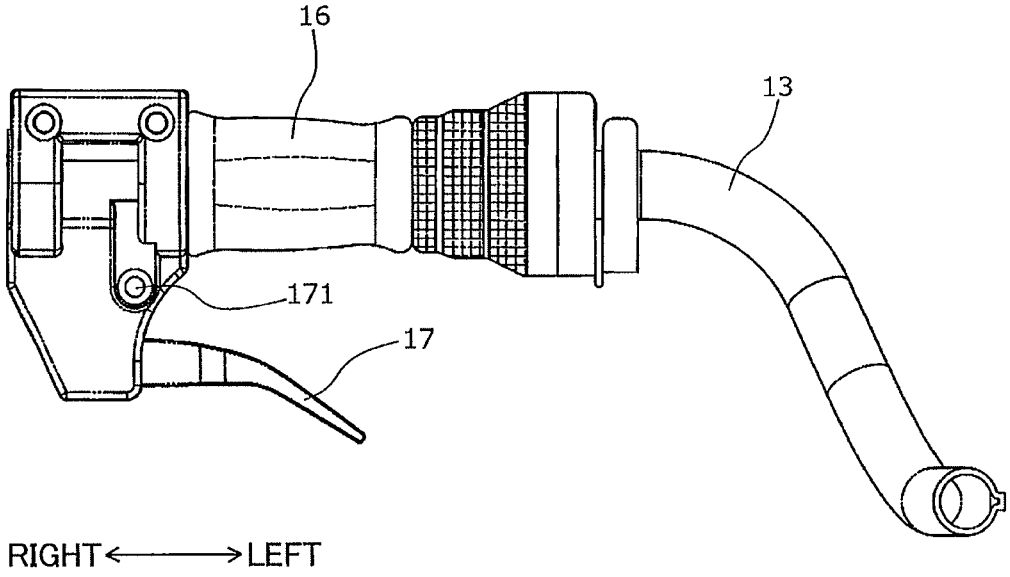
FIG. 3 is a side view showing a configuration near a distal end of a handle of the brush cutter according to the embodiment.

Handles 13 for gripping by an operator are provided at respective left and right sides near a center portion of the shaft 20 in the front-rear direction. In FIG. 1A, only one of the handles 13 (right handle 13) is shown. A grip 16 is provided on a distal end portion of each of the handles 13. Referring to FIG. 3, on the right handle 13, a throttle lever 17 is also provided for realizing switching the rotation speed of the engine 40 (rotation speed of the crank shaft 42) between an idling state and a working state, as will be described later. The throttle lever 17 is pivotally movable about a throttle lever pivot 171 provided near the distal end side of the grip 16.

Further, a waist pad portion 21 is provided on the shaft 20 between the handles 13 and drive section 30 for facilitating operator's operations while holding the handles 13. Specifically, the waist pad portion 21 is formed by an elastic material provided on the shaft 20 to cover (surround) the same such that the waist pad portion 21 has an outer diameter larger than that of the shaft 20. The operator performs cutting work while gripping the handles 13 (grips 16) with his or her waist supported by the waist pad portion 21. Still further, an antiscattering cover 14 is provided below the cutting blade 11 for preventing cut grass and branches from being scattered toward the operator.

The drive section 30 includes the engine 40, a fuel tank 60, a protective cover 15, a carburetor 70, an air cleaner 50, a muffler 80 and a wind governor 90. The fuel tank 60 is fixedly provided below the engine 40 for storing fuel. Before using the brush cutter 310, the operator should remove a tank cap 61 (see FIGS. 1A, 1B and 2) for supplying fuel into the fuel tank 60. In general, a fuel tank and its tank cap are provided below an engine in order to prevent supplied fuel from adhering to an ignition plug provided at the engine or wirings connected to the ignition plug. The fuel tank 60 is thus positioned at a lower rear end portion of the brush cutter 310 (lower portion of the drive section 30).

As illustrated in FIGS. 1A and 1B, the protective cover (stand) 15 is provided to cover a lower portion of the fuel tank 60. The protective cover 15 is made of a resin material and is designed to support the brush cutter 310 when the brush cutter 310 is placed on the ground.

Figure 2:
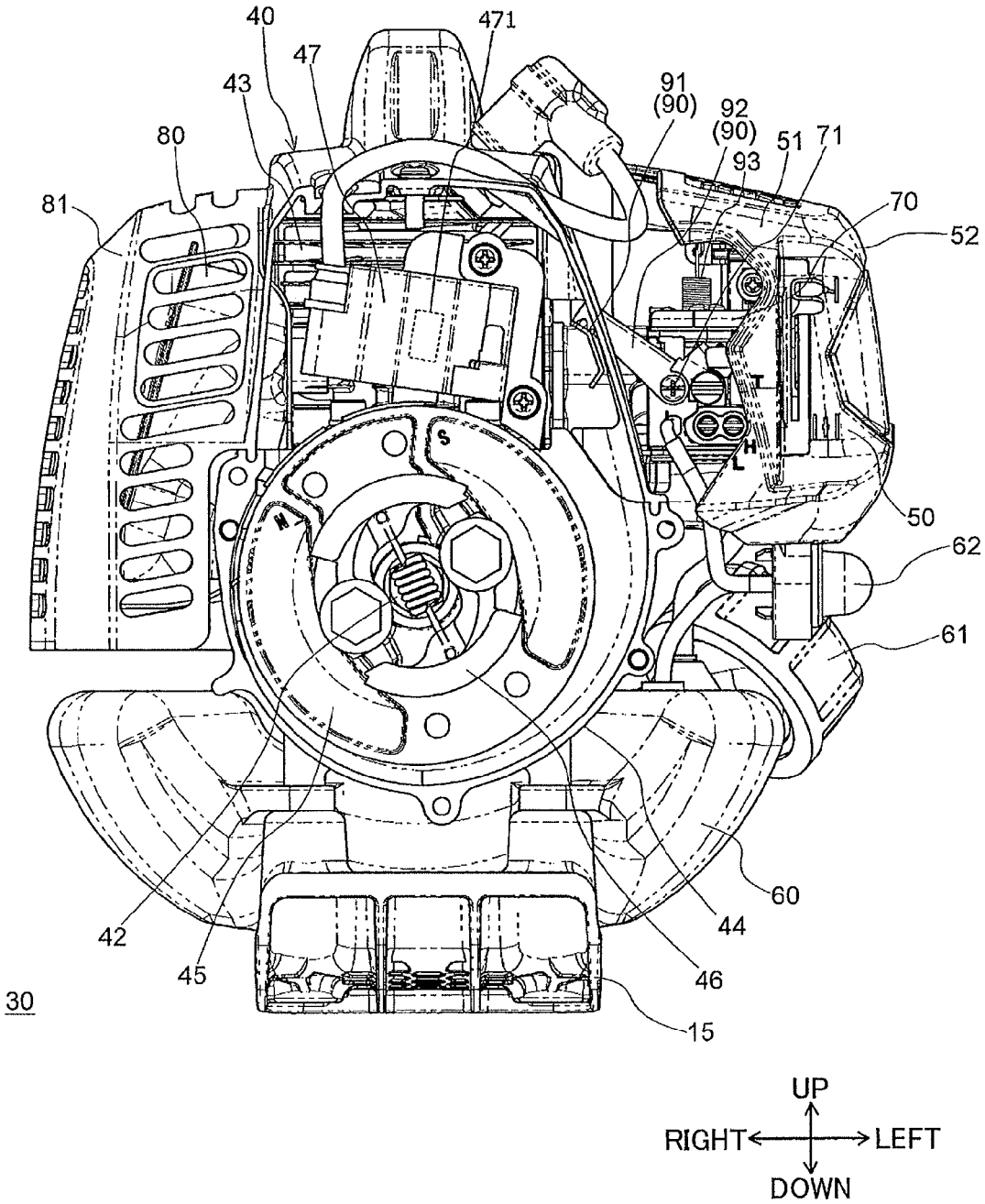
FIG. 2 is a front view of the drive section, without a fan case, of the brush cutter according to the embodiment, wherein the drive section includes an engine and a wind governor.

Referring to FIG. 2, the engine 40 is a compact two-cycle air-cooled engine and includes a cylinder 43, the crank shaft 42 and a cooling fan (not shown). The cylinder 43 is provided in an upper portion of the engine 40. The cylinder 43 mainly includes a combustion chamber and a piston (not shown). The cylinder 43 has an outer peripheral surface in which a large number of cooling fins are formed. The cooling fan (not shown) is fixed to a front end portion of the crank shaft 42. A suction port (not shown) is provided to the left of the cylinder 43 and an exhaust port (not shown) is provided to the right of the cylinder 43.

The carburetor 70 (an example of an output controller) is attached to the suction port provided on the left side (on the right side in FIG. 2) of the cylinder 43. The air cleaner 50 is attached to a left end portion of the carburetor 70. More specifically, the air cleaner 50 is covered with an air cleaner cover 52 and is attached to an air cleaner box 51 fixed to the carburetor 70. With this structure, air is introduced into the carburetor 70 through the air cleaner 50. Fuel is also supplied to the carburetor 70 from the fuel tank 60 via a tube. The carburetor 70 is configured to generate air-fuel mixture therein and supply the same to the engine 40.

The muffler 80 is attached to the exhaust port provided to the right (on the left side in FIG. 2) of the cylinder 43. Through the muffler 80, air from the engine 40 (cylinder 43) is exhausted. The muffler 80 tends to be hot in temperature when used and is therefore covered by a muffler cover 81.

In the engine 40, a crank case 44 is provided below the cylinder 43. The crank case 44 includes the crank shaft 42 thereinside. The crank shaft 42 is configured to rotate in association with a vertical reciprocating movement of the piston within the cylinder 43. The crank shaft 42 extends in the front-rear direction in FIG. 1A (in a direction perpendicular to the sheet surface of FIG. 2). On the front end portion if the crank shaft 42, a magnet rotor 45 and the centrifugal clutch 46 are provided. The magnet rotor 45 is integral with the cooling fan (not shown) for generating cooling air for cooling the cylinder 43. The generated cooling air is configured to flow through a fan case 31 covering the cooling fan (see FIG. 1B) and form an air flow path for cooling the cylinder 43 which becomes particularly hot among other components in the engine 40. On the other hand, a starter (recoil starter) 41 is attached to a rear end portion of the crank shaft 42 to forcibly rotate the crank shaft 42 for staring the engine 40 (see FIGS. 1A, 1B and 4). With this structure, current flows through a generator coil (not illustrated) as the magnet rotor 45 rotates, and the current flows into an ignition coil 47 (ignition system), is accumulated therein up to a level high enough to ignite the ignition plug (not shown), and then supplied to the ignition plug. An ignition control unit 471 including a CPU is provided adjacent to the ignition coil 47 (FIG. 2) for performing control over the ignition coil 47, details of which will be described later.

Figure 4:
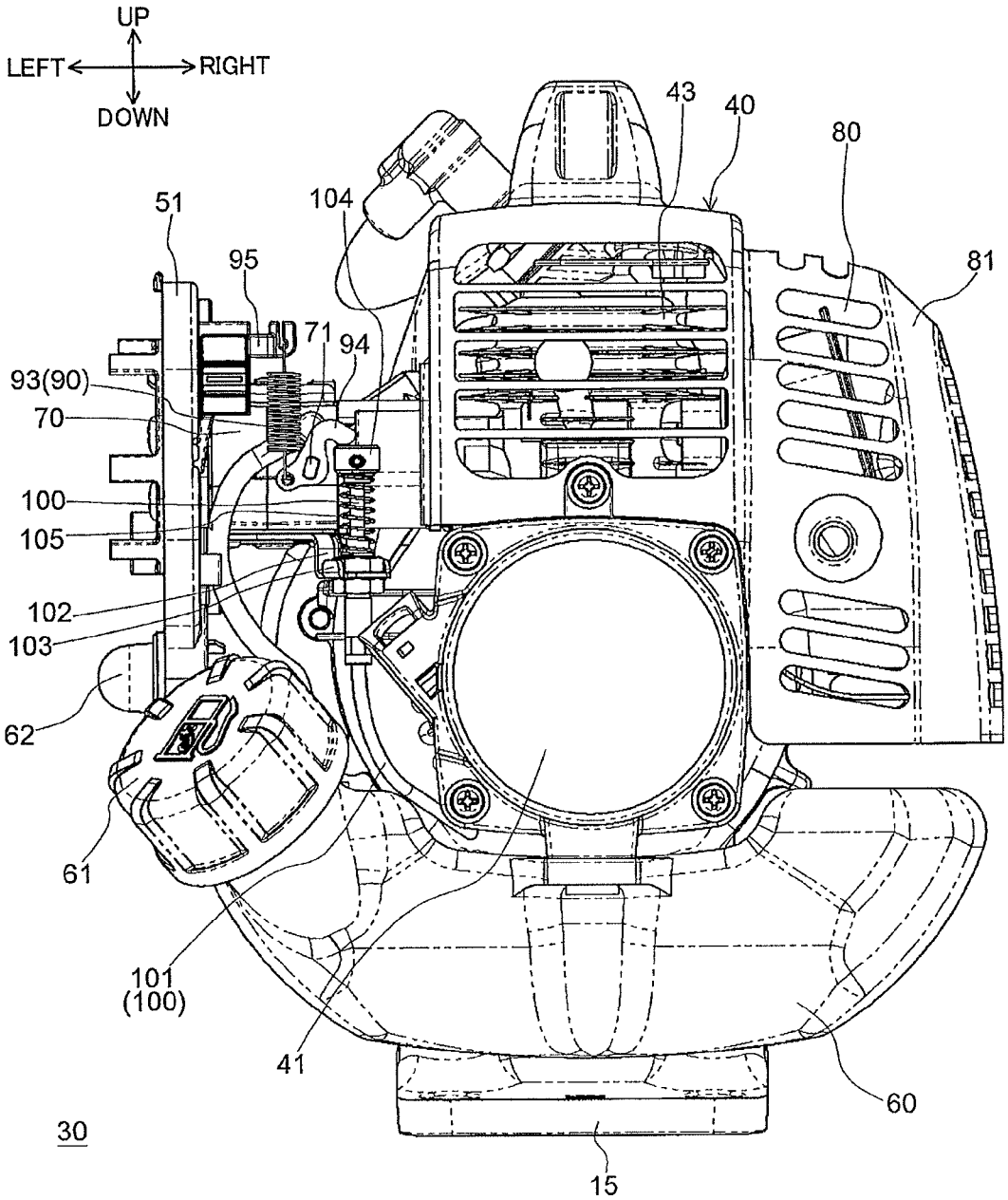
FIG. 4 is a rear view of the drive section of the brush cutter according to the embodiment.
Figure 5B:
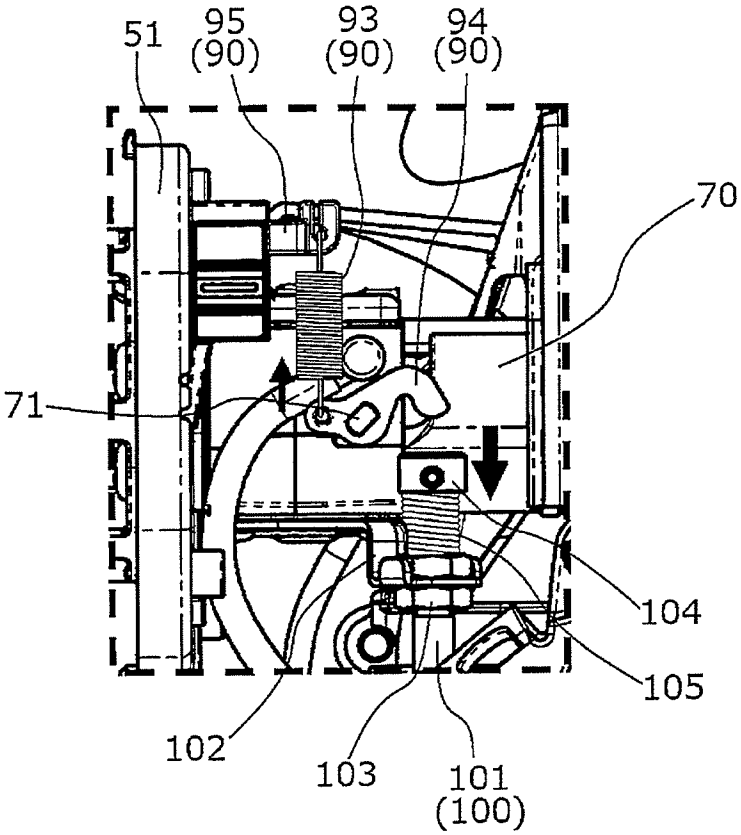
FIGS. 5A and 5B are views explaining switching operations between an idling state and a working state in the brush cutter of the embodiment as viewed from the rear side thereof.
Figure 5A:
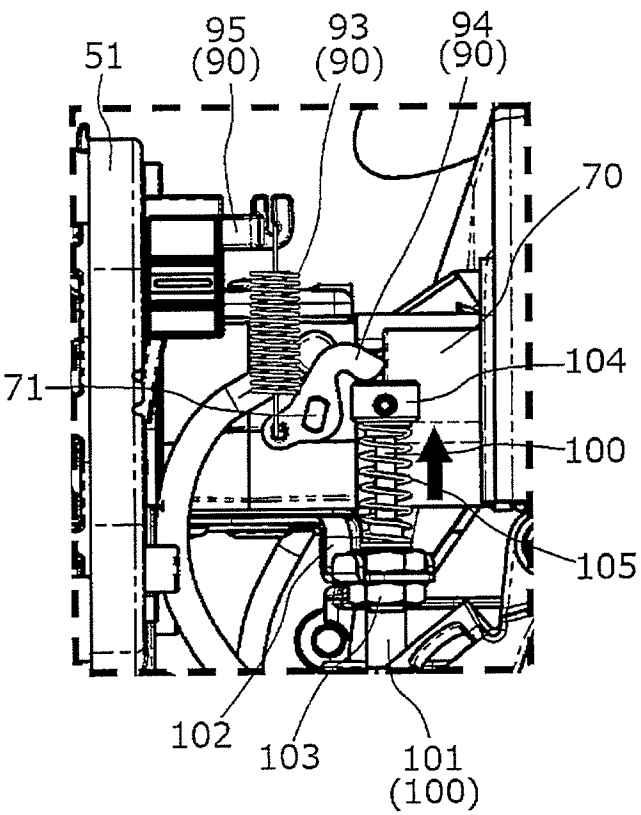

Once the engine 40 has started, the fuel is introduced (sucked) from the fuel tank 60 up to the carburetor 70 by a negative pressure generated at the time of air intake. However, before the engine 40 is started, the fuel needs to be manually taken up to the carburetor 70. To this end, a priming pump 62 is provided as shown in FIGS. 2 and 4. As the operator operates the priming pump 62, the fuel is pumped up from the fuel tank 60 to the carburetor 70 before the engine 40 is started.

While the fuel (mixed gasoline) is supplied from the fuel tank 60 to the carburetor 70, air is also introduced into the carburetor 70 through the air cleaner 50. An air-fuel mixture is generated in the carburetor 70 and is supplied to the engine 40.

A combination of an engine and a carburetor having similar configurations as the engine 40 and carburetor 70 can be used not only for an engine-powered work tool such as the brush cutter 310 of the present embodiment, but also be applicable to other machines, such as a motorbike. However, in case of a motorbike, an angle formed between its carburetor and the ground (horizontal plane) does not vary significantly while the motorbike is in operation (during driving). In contrast, in case of the brush cutter 310, an angle formed between the shaft 20 and the ground (horizontal plane) is often likely to change while the brush cutter 310 is being used. For example, the operator may hold the shaft 20 horizontally generally parallel to the ground, or may turn the shaft 20 into an orientation significantly inclined relative to the horizontal plane in order to adjust a cutting angle.

Although there are various types of carburetors, a diaphragm-type carburetor is effective for stably supplying fuel and generating air-fuel mixture even when the angle between the carburetor and the horizontal plane varies significantly. In the diaphragm-type carburetor, a fuel chamber formed within the carburetor is partitioned by a diaphragm formed of an elastic body, and fuel is sucked up into this fuel chamber and stored therein by a certain amount. This configuration allows stable supply of the air-fuel mixture irrespective of the angle of the carburetor relative to the horizontal plane. For this reason, the diaphragm-type carburetor is preferable as the carburetor 70 of the present embodiment.

The carburetor 70 is also a so-called butterfly-type carburetor and includes a throttle valve shaft 71 and a butterfly valve (not shown). The throttle valve shaft 71 is configured to angularly rotate about its axis extending in the front-rear direction in response to operations of the wind governor 90, as will be described later. The butterfly valve is configured to pivotally move within and relative to the throttle valve shaft 71 in accordance with the angular rotation of the throttle valve shaft 71. By how much the throttle valve shaft 71 angularly rotates and by how much the butterfly valve pivotally moves relative to the throttle valve shaft 71 in response to the angular rotation of the throttle valve shaft 71 determines a throttle opening of the throttle valve shaft 71 (or the carburetor 70). In the carburetor 70 of this structure, the throttle opening can be adjusted in accordance with the angular rotation of the throttle valve shaft 71. Generally speaking, such a butterfly-type carburetor is preferable as a carburetor for an engine-powered work tool. In other words, a diaphragm-type carburetor provided with a throttle opening adjusting mechanism using a butterfly valve is particularly preferable to be used in an engine-powered work tool, just as the carburetor 70 of the present embodiment.

A rotation speed (the number of rotations) of the engine 40 (output of the engine 40) is controlled based on an amount of the air-fuel mixture supplied from the carburetor 70. A rotating state of the engine 40 can be roughly divided into two: an idling state and a working state. In the idling state, the rotation speed of the engine 40 (output of the engine 40) is maintained low and the centrifugal clutch 46 is not connected to the drive shaft to prevent the cutting blade 11 from rotating. In the working state, the rotation speed of the engine 40 (output of the engine 40) is maintained higher than that in the idling state, and the centrifugal clutch 46 is connected to the drive shaft to permit the cutting blade 11 to rotate.

In order to realize switching between the idling state and working state, the operator pulls (grips) the throttle lever 17 provided near the right grip 16 (shown in FIG. 3). The throttle lever 17 is connected to a throttle wire 100 (FIG. 4) that is connected to the carburetor 70. That is, throttle wire 100 has one end connected to the throttle lever 17, and another end connected to the carburetor 70. When the operator grips the throttle lever 17 to pivotally move a right end portion thereof upward in FIG. 3 about the throttle lever pivot 171, the throttle wire 100 can be pulled toward the handle 13 side, by which the carburetor 70 is brought into its working state, as will be described later. A switching operation between the idling state and the working state can be thus performed by movement of the one end of the throttle wire 100 at the drive section 30 side.

The throttle wire 100 is slideably movably provided inside an outer tube 101, as shown in FIG. 4. The outer tube 101 is fixed, by a mounting nut 103, to a throttle wire mounting portion 102 fixed to the carburetor 70. The end (end portion) of the throttle wire 100 (opposite to the end connected to the throttle lever 17) is exposed from the outer tube 101 above the throttle wire mounting portion 102. The end portion of the throttle wire 100 exposed from the outer tube 101 has an upper end to which an arm abutting portion 104 is attached. The arm abutting portion 104 is configured to abut on a right end portion of an arm 94 of the wind governor 90 from below, as will be described later. Further, a throttle return spring 105 is disposed between the arm abutting portion 104 and throttle wire mounting portion 102 such that the throttle wire 100 exposed from the outer tube 101 is wound around by the throttle return spring 105. The arm abutting portion 104 and throttle wire 100 connected thereto are thus normally biased upward due to expansion (biasing force) of the throttle return spring 105, thereby biasing the arm abutting portion 104 toward the arm 94.

Cutting work is performed only in the working state. In the working state, first, in a no-load-applied condition, the rotation speed of the engine 40 is set to a prescribed rotation speed. Then, when the operator puts the rotating cutting blade 11 in contact with grass and branches, a large load is applied to the cutting blade 11, and hence the throttle opening needs to be increased to increase the engine output. After that, when the operator separates the cutting blade 11 from grass and branches in order to finish the cutting work, the load applied to the cutting blade 11 decreases rapidly. If the throttle opening has been increased in this state, the rotation speed may possibly increase rapidly. Hence, when no load is applied, the throttle opening needs to be decreased.

For controlling the throttle opening (angular rotation of the throttle valve shaft 71), the wind governor 90 is provided on the throttle valve shaft 71 of the carburetor 70, referring to FIGS. 2 and 4. The wind governor 90 utilizes the cooling air generated by the cooling fan to control the rotation speed of the engine 40 in the working state. The wind governor 90 is arranged to be on the air flow path of the cooling air so as to receive the cooling air within the fan case 31. The wind governor 90 is thus subject to the strength of the cooling air applied thereto.

Specifically, the wind governor 90 includes a governor plate 91, a governor rod 92, a governor spring 93 and the arm 94.

The governor plate 91 is configured to receive the cooling air. As shown in FIGS. 2 and 6A to 6C, the governor plate 91 is provided on a distal end of the governor rod 92. The governor rod 92 has a generally rectangular shape elongated in the left-right direction in a front view. The governor rod 92 has a base end connected to a front end portion of the throttle valve shaft 71. The governor plate 91 is thus mechanically linked to the throttle valve shaft 71 via the governor rod 92. Upon receipt of the cooling air at the governor plate 91, the governor rod 92 is configured to apply a force to the throttle valve shaft 71 to cause the throttle valve shaft 71 to angularly rotate clockwise or counterclockwise in FIGS. 2 and 6A to 6C.

Further, on the distal end of the governor rod 92, a position-sensor sensed portion 96 is also provided. This position-sensor sensed portion 96 is configured to be sensed by a position sensor 97 that is fixed to the fan case 31. The position sensor 97 may be fixed to the cylinder 43.

Further, as shown in FIG. 4, the arm 94 is fixed to a rear end portion of the throttle valve shaft 71 (i.e., the arm 94 is positioned on an end of the throttle valve shaft 71 opposite to the end on which the governor plate 91 is provided). Note that in FIG. 4, the air cleaner 50 and air cleaner cover 52 are removed. The arm 94 has a left end portion engaged with a lower end of the governor spring 93. The governor spring 93 has an upper end that is positioned higher than the arm 94 and is engaged with a governor spring mounting portion 95 provided on the air cleaner box 51 fixed to the carburetor 70. With this structure, the arm 94 (left end portion thereof) is normally pulled (biased) upward in FIG. 4 by a biasing force of the governor spring 93. The governor spring 93 is configured to bias the throttle valve shaft 71 in a direction to increase the throttle opening (to increase the rotation speed of the engine 40), i.e., clockwise in FIG. 4 (counterclockwise in FIG. 2).

That is, in FIG. 4, the left end portion of the arm 94 (throttle valve shaft 71) is biased clockwise by the governor spring 93, while the right end portion of the arm 94 is biased counterclockwise by the throttle return spring 105 through the arm abutting portion 104. That is, the left and right end portions of the arm 94 are biased respectively in two opposite directions.

It should be noted that the torque applied to the arm 94 from the throttle return spring 105 is set to be larger than the torque applied to the arm 94 from the governor spring 93. Hence, as long as the throttle return spring 105 expands, the arm abutting portion 104 abuts on the right end portion of the arm 94 from below irrespective of the state of the governor spring 93. The throttle valve shaft 71 is thus biased in the counterclockwise direction in FIG. 4 (clockwise direction in FIG. 2). In other words, while the throttle wire 100 is not operated and thus the throttle return spring 105 is not contracted downward, the throttle opening is rendered small (reduced). This is the idling state (shown in FIGS. 4 and 5A). In the idling state, the centrifugal clutch 46 is not connected, and the cutting blade 11 is not driven.

When the operator grips the throttle lever 17, the throttle wire 100 is pulled downward in FIG. 4 against the biasing force of the throttle return spring 105. This is the working state shown in FIG. 5B. At this time, since the arm abutting portion 104 is separated from the arm 94, the arm 94 is caused to pivotally move (throttle valve shaft 71 rotates) in the clockwise direction by the governor spring 93. As a result, the rotation speed of the engine 40 increases, the centrifugal clutch 46 is connected to rotate the cutting blade 11.

At this time, in the working state, the wind governor 90 is used to perform control as described below with reference to FIGS. 6A to 6C.

Figure 6A:
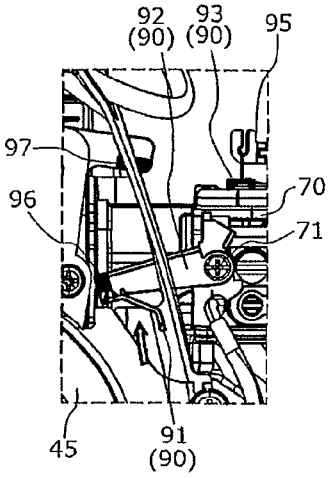
FIGS. 6A to 6C are views illustrating operations of the wind governor in the brush cutter of the embodiment as viewed from the front side thereof.
Figure 6B:
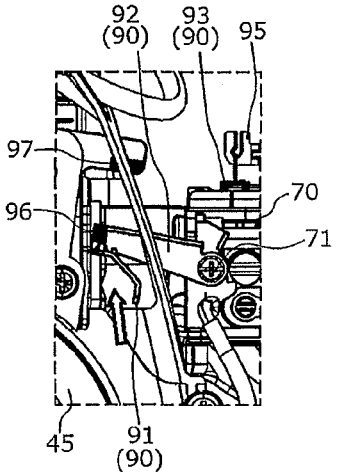
Figure 6C:
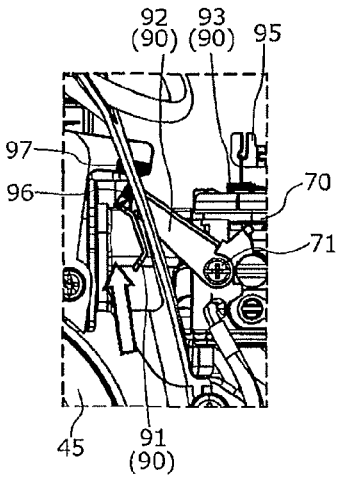

In FIGS. 6A to 6C, the flow (strength) of the cooling air is indicated by a white arrow. FIG. 6A illustrates a state where the rotation speed of the engine 40 is low (strength of the cooling air is low), FIG. 6C illustrates a state where the rotation speed of the engine 40 is high (strength of the cooling air is high), and FIG. 6B illustrates an intermediate state between FIGS. 6A and 6C.

In the wind governor 90, when the cooling air applied to the governor plate 91 increases (a larger pressure is applied to the governor plate 91 from the cooling air), the throttle valve shaft 71 is caused to angularly rotate in a direction to reduce the throttle opening (i.e., clockwise direction in FIGS. 6A-6C) to reduce the rotation speed of the engine 40. Note that, at this time, the arm 94 provided on the other end of the throttle valve shaft 71 is biased by the governor spring 93 in the direction to increase the throttle opening.

Specifically, when the rotation speed of the engine 40 decreases and the strength of the cooling air is reduced as shown in FIG. 6A in response to application of a load to the cutting blade 11, the governor spring 93 causes the throttle valve shaft 71 to angularly rotate in a direction to increase the throttle opening, i.e., clockwise in FIG. 4, to increase the rotation speed of the engine 40. In contrast, when the rotation speed of the engine 40 increases and the strength of the cooling air is increased as shown in FIG. 6C in response to cancellation of the load applied on the cutting blade 11, the governor spring 93 causes the throttle valve shaft 71 to angularly rotate in a direction to reduce the throttle opening, i.e., counterclockwise in FIG. 4 to decrease the rotation speed of the engine 40. Thus, the output of the engine 40 is controlled appropriately. Further, through these operations, the rotation speed of the engine 40 is controlled substantially constant when no load is applied to the cutting blade 11. This rotation speed of the engine 40 defined by the wind governor 90 under no load is a designated rotation speed of the engine 40.

The designated rotation speed is determined by adjusting relationships among the wind governor 90 (the governor plate 91, a spring constant of the governor spring 93, etc.), the throttle valve shaft 71, and the like. For example, the designated rotation speed can be increased when tension (spring constant) of the governor spring 93 is increased, while the designated rotation speed can be decreased when this tension is reduced. Alternatively, for example, by changing an attachment position of the governor spring 93, too, the designated rotation speed or the engine output corresponding to the designated rotation speed can be made variable. These are possible example of designated rotation speed changing means that may be provided in the brush cutter 310 of the present embodiment.

Generally, in case of an engine without a wind governor, output of the engine is likely to become larger as the rotation speed is higher, at least in a rotation speed range lower than or equal to its designated rotation speed. Hence, by increasing the designated rotation speed, a larger output can be obtained from the engine in the working state. However, if the designated rotation speed is increased, vibrations, noises, or increase in fuel consumption will result even when cutting work is not actually performed in the working state. Thus, increasing the designated rotation speed is not preferable to obtain a larger output. Rather, it is desirable to obtain a larger engine output at a low rotation speed, without increasing the designated rotation speed.

To this end, in the brush cutter 310 of the present embodiment, due to provision of the wind governor 90, the above-described control to decrease or increase the output of the engine 40 is performed based on the movement of the wind governor 90, especially based on the movement of the governor plate 91 configured to move upon receipt of the cooling air to cause angular rotation of the throttle valve shaft 71. Further, in the brush cutter 310 of the present embodiment, the output of the engine 40 is also controlled to decrease by controlling ignition by the ignition coil (ignition system) 47, in addition to the control by the wind governor 90. Specifically, the control for reducing the output of the engine 40 is performed by the ignition control unit 471 when the governor plate 91 moves past a predetermined position (switching position). The switching position is determined depending on the designated rotation speed of the engine 40 under no load condition in the working state that is defined by the wind governor 90. Combining the output reduction control of the engine 40 with the operations of the wind governor 90 can realize faster control (accelerate control speed) over the rotation speed (output) of the engine 40 than a case where only the wind governor 90 is employed.

Specifically, as a method for controlling the ignition coil 47, either ignition timing control or ignition thin-out control may be performed.

In either ignition timing control or ignition thin-out control, the position sensor 97 is used for detecting the position of the position-sensor sensed portion 96 provided on the governor rod 92 of the wind governor 90, as shown in FIGS. 6A-6C. Because the governor plate 91 is fixed to the governor rod 92, the position of the governor plate 91 can be sensed indirectly by the position sensor 97. As shown in FIG. 2, the ignition coil 47 is connected to the ignition control unit 471. The position sensor 97 is configured to output information indicative of the position of the position-sensor sensed portion 96 to the ignition control unit 471. With this structure, the ignition control unit 471 is configured to control the ignition coil 47 (timing at which the ignition coil 47 outputs a high voltage) based on the output from the position sensor 97. That is, in this example, the wind governor 90 (position-sensor sensed portion 96) and the position sensor 97 in combination serve as a rotation speed detector. The rotation speed detector recognizes whether the rotation speed (the number of rotations) of the crank shaft 42 exceeds a certain value. If the rotation speed exceeds this value, the ignition condition is caused to change such that the engine output is reduced.

Figure 7:
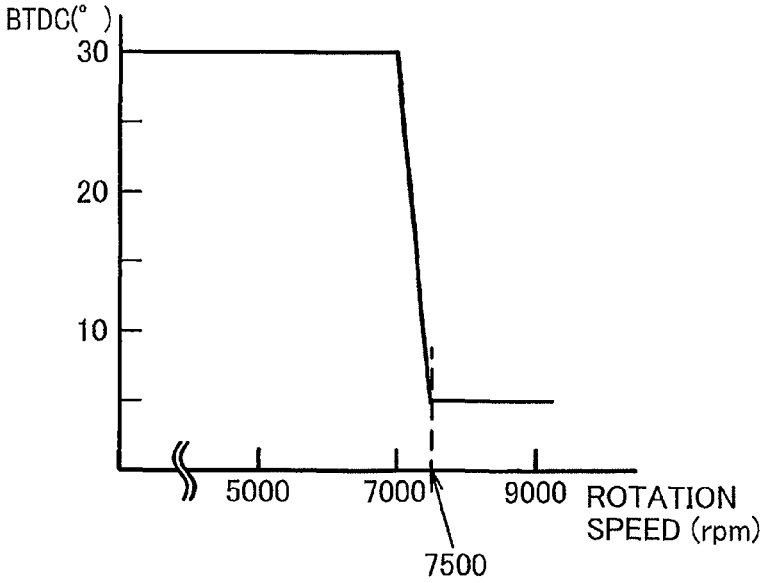
FIG. 7 is a graph showing a relationship between the rotation speed and ignition timing of the engine under an ignition timing control of the embodiment.

First, the ignition timing control to decrease the engine output will be described with reference to FIG. 7. Here, it is assumed that the ignition plug is ignited by the ignition coil 47 each time the crank shaft 42 makes one rotation, and that only ignition timing (BTDC: Before Top Dead Center) is controlled. In FIG. 7, the ignition timing is shown by a phase angle (°)of rotation of the crank shaft 42 from the top dead center. Here, the BTDC is set to 30° when the rotation speed is lower than or equal to 7000 rpm, and is set to be equal to or smaller than 10° when the rotation speed exceeds 7000 rpm. Generally, in order to obtain an appropriate engine output (to increase output), the ignition timing needs to be advanced (moved ahead) before the top dead center of the piston (advanced ignition). An appropriate BTDC for this advanced ignition is assumed to be 30° in the example of FIG. 7. Hence, by setting the BTDC to be equal to or smaller than 10°, the output of the engine 40 is controlled to be reduced low. According to the ignition timing shown in FIG. 7, the output of the engine 40 is controlled to increase when the rotation speed is lower than or equal to 7000 rpm, and the output is controlled to decrease rapidly (for example, by provoking misfire) when the rotation speed exceeds 7000 rpm. In other words, the rotation speed of 7000 rpm is a threshold to determine whether to change the BTDC in the present embodiment.

Because the cooling fan is fixed to the crank shaft 42, the strength of cooling air and the rotation speed have one-to-one correspondence in both of the idling state and the working state. Thus, the rotation speed of the engine 40 and the position of the governor plate 91 (the angle of the governor rod 92) also have one-to-one correspondence. Hence, the rotation speed in FIG. 7 can be read to correspond to the angle of the governor rod 92 or the position of the position-sensor sensed portion 96. The position of the position-sensor sensed portion 96 can be detected by the position sensor 97. For example, the ignition control unit 471 can determine, based on the output of the position sensor 97, whether the position-sensor sensed portion 96 reaches a position corresponding to the rotation speed of 7000 rpm (switching position).

According to the ignition timing control shown in FIG. 7, the rotation speed of the engine 40 under no load in the working state (designated rotation speed) is set to 7500 rpm. The designated rotation speed is determined by the relationship between the wind governor 90 and the throttle valve shaft 71, as described above. Thus, if a load is applied to the cutting blade 11 in the working state and the rotation speed drops, the wind governor 90 functions to increase the throttle opening to bring the rotation speed back to lower than or equal to 7000 rpm. The engine output is thus increased.

In this state, if the load applied to the cutting blade 11 is cancelled suddenly, the rotation speed of the engine 40 increases rapidly due to the large throttle opening. At this time, as described above, the throttle opening is controlled to decrease by the wind governor 90. In the present embodiment, if the rotation speed exceeds 7000 rpm (as a threshold), the ignition timing is also controlled to be retarded (BTDC is reduced to about 5° in case of the example of FIG. 7). In other words, the engine 40 is controlled to cause misfire to decrease output as necessary, in addition to reduction of the throttle opening by the wind governor 90. Thus, the rotation speed of the engine 40 (engine output) can be reduced at a faster speed (at a faster rate) than if only the wind governor 90 was employed. The rotation speed of the engine 40 is thus controlled so as not to exceed a certain value over 7000 rpm (for example, 7500 rpm).

Further, when the rotation speed becomes lower than or equal to 7000 rpm due to this operation, the throttle opening is increased by the wind governor 90 and, at the same time, as shown in FIG. 7, the BTDC is again controlled to be 30° to increase the output of the engine 40. Thus, the output of the engine 40 can be increased at a faster speed (at a faster rate) than if only the wind governor 90 was employed. That is, when a load is applied, the engine output can be increased rapidly, compared with a case where only the wind governor 90 is employed.

With the above-described ignition timing control, original performance of the engine 40 can be extracted efficiently. This point will be described below with reference to FIG. 8.

Figure 8:
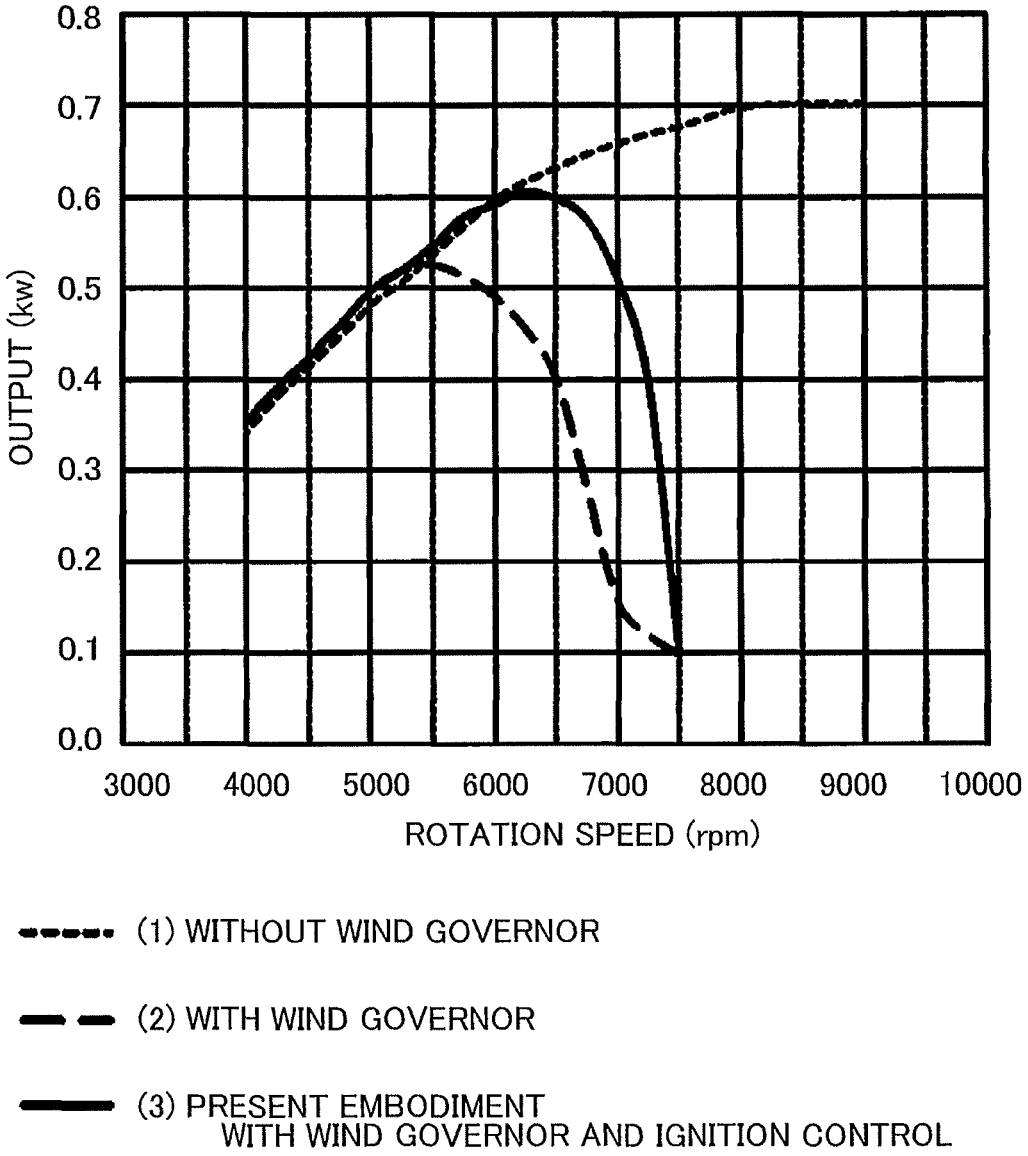
FIG. 8 is a graph comparing output characteristics of the engine of the embodiment with output characteristics of conventional engines, wherein a curve (1) represents output characteristics of a conventional engine without a wind governor, a curve (2) represents output characteristics of a conventional engine provided with a wind governor, and a curve (3) represents output characteristics of the engine of the embodiment.

A curve (1) in FIG. 8 represents a relationship between the output and rotation speed of the engine (output characteristics) in a case where the output control is performed only by the throttle valve shaft without the wind governor. A curve (2) represents corresponding output characteristics in a case where the wind governor having the designated rotation speed of 7500 rpm is employed. Here, the curve (1) shows original output characteristics of the engine: the curve (1) provides the highest output at all rotation speeds, and increases as the rotation speed increases in the rotation speed range shown in FIG. 8. In the curve (2), the governor spring in the wind governor functions to adjust the output such that the designated rotation speed becomes 7500 rpm.

Here, when the rotation speed is low, cooling air is weak and the governor plate does not move. Hence the wind governor does not function practically. Thus, in a low rotation speed range near the idling state, output of (2) is equivalent to that of (1). In a high rotation speed range higher than the designated rotation speed, the wind governor suppresses the engine output considerably, and thus the output of (2) is considerably reduced lower than that of (1). Note that the wind governor also functions in a rotation speed range lower than or equal to the designated rotation speed and, in this rotation speed range, the output of (2) is suppressed lower than that of (1). Specifically, in case of the curve (2) where the wind governor is employed, while the wind governor performs the above-described control based on the designated rotation speed of 7500 rpm, the wind governor starts controlling the engine output gradually from a low rotation speed much lower than 7500 rpm. Thus, the output of (2) is considerably lower than that of (1) even in the rotation speed range of approximately 6000 to 6500 rpm. As a result, in case (2) where the wind governor is provided, original output of the engine is considerably reduced low even in the rotation speed range lower than or equal to the designated rotation speed in the working state.

On the other hand, a curve (3) in FIG. 8 represents output characteristics of the present embodiment in which the above-described ignition timing control and the control by the wind governor 90 are both performed, compared with those of the curves (1) and (2). In case of the curve (3), the output characteristics at rotation speeds higher than the threshold of 7000 rpm are steeper (drops drastically) than the output characteristics of (2). As a result, whereas the curves (2) and (1) separate at the rotation speed of approximately 5500 rpm, the curves (3) and (1) separate at the rotation speed of around 6000 rpm or higher. Thus, as shown in (3) in FIG. 8, the peak of the output characteristics of (3) can be made closer to the peak of the output characteristics of (1). This means that, in the engine output characteristics curve of (3), change in engine output can be made steeper (more drastic) near an upper-limit rotation speed in the working state. Hence, the engine output obtained in the working state can be increased. In other words, although the wind governor 90 of (3) is set to operate at a rotation speed higher than the rotation speed of the wind governor shown in (2) in terms of mechanical settings (without considering the effects of the ignition timing control), the wind governor 90 of (3) maintains the rotation speed at approximately 7500 rpm, similarly as in case of (2) when used concurrently with the ignition timing control of the present embodiment. Note that, at the designated rotation speed (rotation speed under no load in the working state) around 7500 rpm, pivotal movement of the wind governor 90 in case of (3) is smaller than that in case of (2), and the throttle opening of (3) becomes larger than that of (2).

Incidentally, in case of (2), by increasing the designated rotation speed of the wind governor under no load, the output at the rotation speed around 6000 rpm can be increased. In this case, however, since the designated rotation speed of the engine under no load is made higher, fuel consumption increases even when cutting work is not performed actually. In case of (3), in contrast, the engine output in the working state can be increased without increasing the designated rotation speed under no load in the wind governor 90. That is, with the above-described configuration of the present embodiment, decrease in original output of the engine 40 in the working state can be suppressed, and the engine 40 can be used efficiently. Fuel consumption during performing cutting work can also be held low.

Figure 9A:
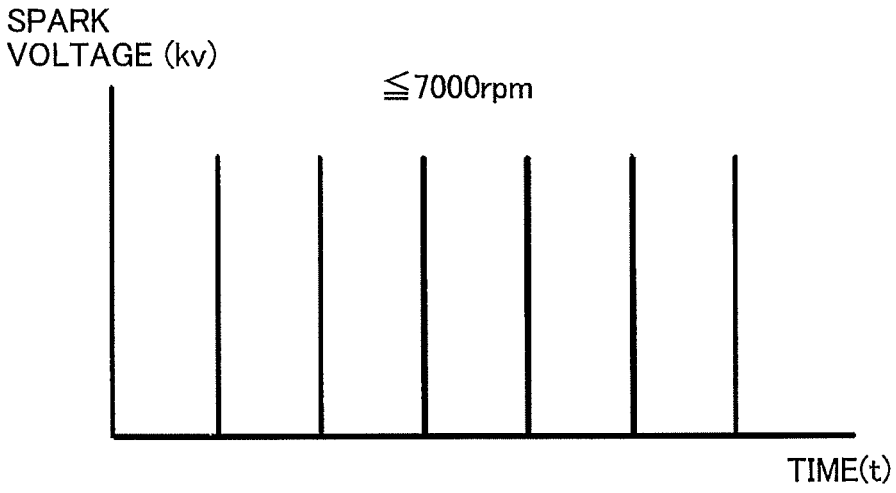
FIGS. 9A and 9B are graphs illustrating how ignition is performed under an ignition thin-out control of the embodiment.
Figure 9B:
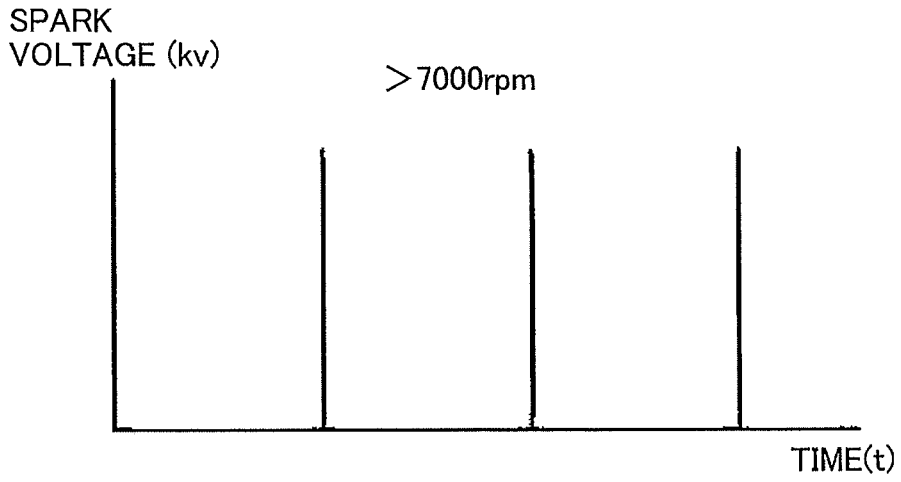

Next, the ignition thin-out control, which may be performed instead of the ignition timing control, will be described with reference to FIGS. 9A and 9B. FIGS. 9A and 9B show transitions in voltage supplied to the ignition plug over time, at the rotation speed lower than or equal to 7000 rpm (FIG. 9A), and at the rotation speed exceeding 7000 rpm (FIG. 9B). For illustration purposes, FIGS. 9A and 9B have different scales of the horizontal axis (time axis). Further, in this ignition thin-out control, BTDC is set to 30° (the value maintained at rotation speeds lower than or equal to 7000 rpm in FIG. 7), regardless of the rotation speed.

In FIG. 9A, an interval at which the voltage is applied corresponds to a time span of one rotation of the crank shaft 42. Hence, in FIG. 9A, the ignition plug performs ignition at each cycle of the crank shaft 42 (at each cycle of piston movement). Thus, at rotation speeds lower than or equal to 7000 rpm, the engine 40 is controlled to generate a normal output.

On the other hand, when the rotation speed of the engine 40 exceeds 7000 rpm, the ignition control unit 471 controls such that ignition by the ignition plug is performed once every two cycles of the crank shaft 42. That is, a frequency of ignition is thinned out to one half. The output of the engine 40 is thus reduced.

With this configuration, when the rotation speed exceeds 7000 rpm, ignition is thinned out to reduce the output of the engine 40. Concurrently with this ignition thin-out control, the control by the wind governor 90 is also performed. Hence, the output characteristics as shown in FIG. 8 can be similarly obtained by the combination of the ignition thin-out control and operations of the wind governor 90.

As a variation, the ignition timing control and ignition thin-out control can be performed concurrently. Similar effects can also be obtained in this case.

As described above, what is significant in the configuration of the brush cutter 310 of the present embodiment is that, two kinds of control are employed in combination for controlling the compact air-cooled engine 40: the wind governor 90 for appropriately controlling the throttle opening in the working state; and the ignition control of the engine 40. This structure can more reliably suppress over speed of the engine 40 under no load condition, and can increase the output of the engine 40 upon application of a load without changing the rotation speed. As a result, engine output obtained in the working state can be increased.

Further, the ignition control of the engine 40 is performed based on the rotation speed (number of rotations) of the engine 40 (crank shaft 42) in the present embodiment. To this end, the wind governor 90 and position sensor 97 are employed as the rotation speed detector for detecting the rotation speed of the engine 40. The rotation speed detector does not need to detect an accurate rotation speed in the entire rotation speed range, but only needs to detect whether the rotation speed reaches the rotation speed (threshold) at which the necessary ignition control is configured to be started. Further, the wind governor 90 itself (position-sensor sensed portion 96) constitutes a part of the rotation speed detector and thus the rotation speed detector can be made simple in structure.

Various modifications and variations are conceivable.

In the depicted embodiment, the throttle valve shaft 71 extends in the front-rear direction to penetrate a main body of the carburetor 70 therethrough, and the governor plate 91 and governor rod 92 are fixed to the one end (front end) of the throttle valve shaft 71, while the arm 94 and governor spring 93 are fixed to the another end (rear end) of the throttle valve shaft 71. However, all these components (governor plate 91, governor rod 92, arm 94, and governor spring 93) may be provided on the same end of the throttle valve shaft 71. In this case, the throttle valve shaft 71 does not necessarily penetrate the main body of the carburetor 70. However, the depicted configuration is particularly preferable to realize a simplified structure near the carburetor 70 and to ensure smooth operations.

Further, as described above, the designated rotation speed changing means may be employed to adjust the wind governor 90 for adjusting the designated rotation speed under no load condition in the working state. In this case, the ignition control unit 471 is configured to recognize settings of the designated rotation speed changing means, and the similar control as in the present embodiment is performed based on the switching position of the governor plate 91 that is set in accordance with the designated rotation speed.

Further, in the depicted embodiment, the ignition timing control or ignition thin-out control is performed in order to decrease the engine output at rotation speeds higher than or equal to the predetermined threshold. However, other means for decreasing engine output may be employed appropriately, provided that such means has no adverse effects on the engine 40.

Further, in the above-described example, the position sensor 97 recognizes the position-sensor sensed portion 96, by which the position of the governor plate 91 can be indirectly recognized. However, other structures may also be used for the similar control by the ignition control unit 471, as long as the position of the governor plate 91 can be recognized directly or indirectly. For example, the angle of the governor rod 92 may be detected for performing similar control by the ignition control unit 471. Such structure for detecting the angle of the governor rod 92 may be configured appropriately depending on the configurations of the wind governor 90 and/or the carburetor 70. In any case, it is clear that a simple-structured sensor is required.

Further, in the above-described example, the wind governor 90 (position-sensor sensed portion 96) and the position sensor 97 are employed as the rotation speed detector. However, the rotation speed (the number of rotations) of the crank shaft 42 may be detected or recognized by another configuration. If this is the case, it is unnecessary to accurately recognize the rotation speed at all rotation speeds, but it is only necessary to determine whether the rotation speed of the crank shaft 42 exceeds a predetermined value, just as in the determination of whether the governor plate 91 reaches the switching position. Hence, the rotation speed detector can have a simple configuration. Note that, the depicted structure of the present embodiment is especially preferable in configuring the rotation speed detector, since only the position sensor 97 is required in addition to the wind governor 90 that has been conventionally employed.

In the depicted example, the brush cutter is used as an example of the engine-powered work tool of the present invention. However, the present invention can also be applicable to other types of portable engine-powered work tools provided with air-cooled engines.

While the invention has been described in detail with reference to the above-described embodiments thereof, it would be apparent to those skilled in the art that various changes and modifications may be made therein without departing from the scope of the invention.

What is claimed is:

1. An engine-powered work tool comprising:

an air-cooled engine including a crank shaft configured to rotate and a cooling fan fixed to the crank shaft and configured to rotate together with the crank shaft to generate cooling air;

an ignition system for igniting the engine;

an output controller configured to control an output of the engine, the output controller including a throttle valve shaft defining an axis and configured to make an angular rotation about the axis, the output of the engine being controlled based on the angular rotation of the throttle valve shaft;

a wind governor connected to the throttle valve shaft and including a governor plate configured to move upon receipt of the cooling air thereon, the wind governor being configured to control the angular rotation of the throttle valve shaft based on an amount of the cooling air received by the governor plate;

a rotation speed detector configured to detect a rotation speed of the crank shaft; and an ignition control unit configured to control the ignition system based on the rotation speed of the crank shaft detected by the rotation speed detector to reduce the output of the engine when the rotation speed detector determines that the governor plate exceeds a predetermined position.

2. The engine-powered work tool as claimed in claim 1, wherein the ignition control unit is configured to reduce the output of the engine by changing ignition timing for igniting the engine when the rotation speed detector determines that the rotation speed of the crank shaft exceeds a predetermined value corresponding to the predetermined position.

3. The engine-powered work tool as claimed in claim 1, wherein the ignition control unit is configured to reduce the output of the engine by thinning out a frequency of ignition when the rotation speed detector determines that the rotation speed of the crank shaft exceeds a predetermined value corresponding to the predetermined position.

4. The engine-powered work tool as claimed in claim 1, wherein the rotation speed detector is configured to detect the rotation speed of the crank shaft based on a position of the governor plate that moves in accordance with the amount of the cooling air.

5. The engine-powered work tool as claimed in claim 4, wherein the ignition control unit is configured to control the ignition system to reduce the output of the engine when the governor plate moves to pass the predetermined position upon receipt of the cooling air.

6. The engine-powered work tool as claimed in claim 5, wherein the wind governor is configured to determine a designated rotation speed of the crank shaft of the engine operating under no load, and the predetermined position is determined based on the designated rotation speed of the crank shaft determined by the wind governor.

7. The engine-powered work tool as claimed in claim 1, wherein the rotation speed detector comprises a position sensor configured to detect a position of the governor plate and to output information indicative of the position of the governor plate, and wherein the ignition control unit is configured to control the ignition system based on the information outputted from the position sensor.

8. The engine-powered work tool as claimed in claim 1, wherein the ignition system comprises an ignition coil configured to generate spark current for igniting the engine, the ignition control unit being positioned adjacent to the ignition coil.

9. The engine-powered work tool as claimed in claim 1, wherein the output controller includes a main body through which the throttle valve shaft penetrates, the throttle valve shaft having one end and another end opposite to each other, the governor plate being fixed to the one end of the throttle valve shaft, and wherein the wind governor further comprises:

an arm fixed to the another end of the throttle valve shaft; and a governor spring connected to the arm to apply a biasing force to the throttle valve shaft.

10. The engine-powered work tool as claimed in claim 1, further comprising:

an end tool configured to be driven in accordance with the rotation of the crank shaft; and a supporting shaft having one end provided with the end tool and another end provided with the air-cooled engine, the ignition system, the output controller, the wind governor and the ignition control unit.

* * * * *